US006972684B2

(12) United States Patent
Copley

(10) Patent No.: US 6,972,684 B2
(45) Date of Patent: Dec. 6, 2005

(54) PERSONAL TRACKING DEVICE

(75) Inventor: Shaun Michael Copley, Lafayette, IN (US)

(73) Assignee: CellTrack, LLC, Lafayette, IN (US)

( * ) Notice: Subject to any disclaimer, the term of this patent is extended or adjusted under 35 U.S.C. 154(b) by 0 days.

(21) Appl. No.: 10/649,486

(22) Filed: Aug. 27, 2003

(65) Prior Publication Data

US 2004/0046667 A1 Mar. 11, 2004

Related U.S. Application Data

(63) Continuation of application No. 10/145,310, filed on May 14, 2002, now Pat. No. 6,639,516.

(51) Int. Cl.[7] ..... G08B 23/00

(52) U.S. Cl. ..... 340/573.4; 340/573.1; 340/539.12; 340/426.17; 340/426.22; 340/7.52; 340/5.58; 340/568.32; 340/568.4; 340/687; 340/825.49

(58) Field of Search ..... 340/573.4, 573.1, 340/539.12, 426.17, 426.22, 7.52, 5.58, 568.2, 340/568.4, 687, 825.49

(56) References Cited

U.S. PATENT DOCUMENTS

| | | | | |
|---|---|---|---|---|
| 4,728,959 A | | 3/1988 | Maloney et al. | |
| 5,103,474 A | | 4/1992 | Stoodley et al. | |
| 5,255,306 A | | 10/1993 | Melton et al. | |
| 5,396,227 A | * | 3/1995 | Carroll et al. | 340/825.36 |
| 5,461,390 A | * | 10/1995 | Hoshen | 342/419 |
| 5,526,357 A | | 6/1996 | Jandrell | |
| 5,731,757 A | * | 3/1998 | Layson, Jr. | 340/573.1 |
| 5,745,037 A | | 4/1998 | Guthrie et al. | |
| 5,867,103 A | | 2/1999 | Taylor, Jr. | |
| 5,959,533 A | | 9/1999 | Layson, Jr. et al. | |
| 5,982,281 A | | 11/1999 | Layson, Jr. | |
| 6,006,097 A | | 12/1999 | Hornfeldt et al. | |
| 6,014,080 A | | 1/2000 | Layson, Jr. | |
| 6,072,396 A | | 6/2000 | Gaukel | |
| 6,100,806 A | | 8/2000 | Gaukel | |
| 6,218,945 B1 | | 4/2001 | Taylor, Jr. | |
| 6,330,452 B1 | | 12/2001 | Fattouche et al. | |
| 6,337,665 B1 | | 1/2002 | Gaukel | |
| 6,351,221 B1 | | 2/2002 | Phillips et al. | |
| 6,405,213 B1 | | 6/2002 | Layson et al. | |
| 6,639,516 B1 | * | 10/2003 | Copley | 340/573.4 |

(Continued)

OTHER PUBLICATIONS

"Location Technologies for GSM, GPRS and WCDMA Networks," White Paper (35 pp.) Snap Track™ Incorporation, a wholly owned subsidiary of QUALCOMM, Inc., © Copyright 1997-2001.

(Continued)

*Primary Examiner*—Daniel Wu
*Assistant Examiner*—Tai T. Nguyen
(74) *Attorney, Agent, or Firm*—Woodard, Emhardt, Moriarty, McNett & Henry LLP

(57) ABSTRACT

A system for monitoring the location of individuals, such as parolees, includes a wearable device worn by the individual and a portable device operatively coupled to the wearable device. The portable device is operatively coupled to a monitoring system through a wireless telephone network. The portable device transmits periodically encrypted location information as well as status information across the wireless network to the monitoring system. The monitoring system tracks the location of the individual and alerts the appropriate authorities when the individual violates a rule, such as a condition for parole. The portable device increases the time between transmissions when the individual is within a specified home location and reduces the time between transmissions when outside the specified location.

17 Claims, 4 Drawing Sheets

U.S. PATENT DOCUMENTS

| | | | |
|---|---|---|---|
| 2001/0026240 | A1 | 10/2001 | Neher |
| 2002/0024443 | A1 | 2/2002 | Hawkins et al. |
| 2002/0196147 | A1 | 12/2002 | Lau |
| 2003/0020623 | A1 | 1/2003 | Cao et al. |

OTHER PUBLICATIONS

"An Introduction to Snap Track™ Server-Aided GPS Technology".

FCC Wireless 911 Requirements, "Fact Sheet." WTB/Policy, Jan. 2001.

"How Location Tracking Will Work" © Copyright 1998-2002 Howstuffworks, Inc.

"Nextel Communications, Inc. Phase II E911 Quarterly Report," Feb. 1, 2002. (Before the Federal Communications Commission, Washington, DC 20554. *In the Matter of Revision of the Commission's Rules to Ensure Compatibility With Enhanced 911 Emergency Calling Systems, Wireless E911 II Implementation Plan of Nextel Communications, Inc.,* Order, FCC 01-295, released Oct. 12, 2001 ("Nextel Waiver Order").).

Snap Track's Personal Location Technology™, "System Description". ©2002 Snap Track, Inc., a QUALCOMM® Company.

Phipps, Jeanine, Purdue Research Parks News, "Research Park startup launches improved electronic monitoring system", Oct. 16, 2003, 4 pages, http://www.purdue.edu/UNS/html4ever/031016.Celltrack.launch.html.

GCS Guidance Control Systems, OM247 Offender Monitoring Electronics, ©2004 Guidance Control Systems Ltd., 4 pages, http://www.gcsltd.com.uk/index.html.

AVID Wireless, Success Story—Nextel GPS Parolee Tracking System, Dec. 15, 2003, ©Copyright AVIDWireless 2002, 2 pages, http://www.avidwireless.com/SuccessParolee.htm.

Kansal, Aman, "Bluetooth Primer", ©2002 Red-M, 30 pages.

* cited by examiner

PERSONAL TRACKING DEVICE

REFERENCE TO RELATED APPLICATIONS

This application is a continuation of U.S. patent application Ser. No. 10/145,310, filed May 14, 2002, now U.S. Pat. No. 6,639,516, issued Oct. 28, 2003, which is hereby incorporated by reference in its entirety.

BACKGROUND OF THE INVENTION

The present invention generally relates to tracking systems, and more specifically, but not exclusively, concerns a tracking system that is able to track home parolees and other similar individuals inside or outside of buildings.

With increased prison population, governments have been trying alternate ways of incarcerating criminals. One popular program is a "house" arrest program for parolees and non-violent offenders. In one such a system, the monitored person wears an ankle bracelet or some other device that ensures the monitored person is able to freely move within a confined geographic area, such as a house. One problem faced with such systems is to be able to accurately determine the location of the monitored individual so as to reduce the number of "false alarms" in which the location of the monitored individual is temporarily lost even though the monitored person remains in the confined location. Due to structures, such as walls of buildings, signals from the locating device may become blocked such that the monitored person has "disappeared" with respect to the locating system.

Another area in the criminal justice system where location of individuals is a concern is in the area of restraining orders. Since the location of the person against whom a restraining order has been issued is usually unknown, the person who obtained the restraining order faces the constant fear that the order could be violated at any time. Due to limited police resources, a large number of restraining order violations can occur without the police even detecting the violation. Even when police are aware of a violation, it takes time for the police to respond to the violation, while the potential victim or at risk person might not be even aware of the violation.

U.S. Patent Application Publication US 2002/0024443 A1 to Hawkins et al., published Feb. 28, 2002 (U.S. patent application Ser. No. 09/940,905, filed Aug. 27, 2001), which is hereby incorporated by reference in its entirety, discloses an automated tracking that uses "fuzzy logic" in determining whether to record location information about a tracked person. Since locations in such a system are recorded a periodically and due to the complexity involve with a fuzzy logic system, there remains a significant risk that a tracked person can circumvent such a system and remain undetected during a violation. Moreover, the Hawkins system fails to address potential privacy concerns when transmitting information over a publicly accessible network, such as wireless telephone network and/or a computer network. The lives of tracked individuals may be placed in danger when their location can be easily determined.

Thus, there remains a need for an improved technique and system for tracking individuals.

SUMMARY OF THE INVENTION

One form of the present invention concerns a unique tracking system and a unique method for tracking individuals.

In one form of the present invention, periodic status signals are received with a portable device from a wearable device worn by a person. The status signals indicate the operational status of the wearable device, and the operational status includes an indication of whether the person has tampered with the wearable device. The portable device determines periodically location of the portable device. Messages are transmitted periodically from the portable device to a monitoring system via a wireless telephone network. The messages include the location of the portable device and the operational status of the wearable device. Transmission rate of the messages from the portable device to the monitoring system is adjusted by reducing the transmission rate when the portable device is within a specified region and increasing the transmission rate when the portable device is outside the specified region.

In further aspect of the present invention, messages are received periodically at a monitoring system from a portable device in possession of a monitored person via a wireless telephone network. The messages include location of the portable device. The allowable time between the messages from the portable device is adjusted by increasing the allowable time between the messages when the portable device is within a specified region and by decreasing the allowable time between the messages when the portable device is outside the specified region. A violation occurs when the allowable time between the messages is exceeded. A law enforcement official is alerted of the violation.

In another form, a processor is operable to receive messages containing location of a portable device in possession of a monitored person via a wireless telephone network. Memory is operatively coupled to the processor, and the memory is operable to store rules pertaining to the monitored person. The rules include an allowable time between the messages and a designated area in which the allowable time between the messages is increased. The processor is operable to increase the allowable time between the messages when the portable device is located in the designated area, and the processor is operable to alert an individual when the portable device violates at least on of the rules in the memory.

Other forms, embodiments, objects, features, advantages, benefits and aspects of the present invention shall become apparent from the detailed drawings and description contained herein.

DESCRIPTION OF SELECTED EMBODIMENTS

Figure 1:
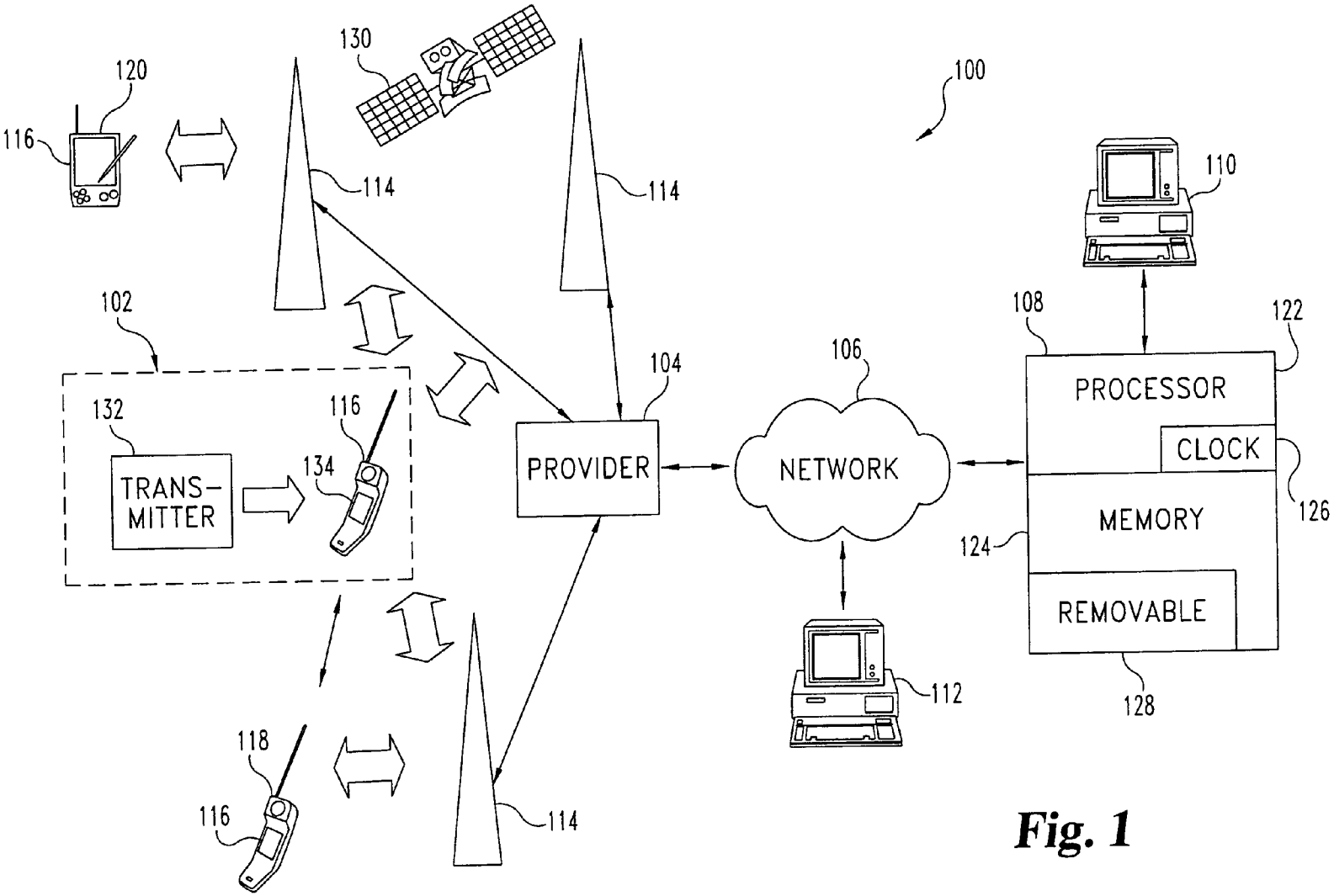
FIG. 1 is a diagrammatic view of a personal tracking system according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. One embodiment of the invention is shown in great detail, although it will be apparent to those skilled in the art that some of the features which are not relevant to the invention may not be shown for the sake of clarity.

A system 100 for tracking monitored individuals according to one embodiment of the present invention is illustrated in FIG. 1. System 100 includes a tracking device 102 for tracking a monitored individual, a wireless telephone provider system 104, a computer network 106 operatively coupled to the wireless provider system or network 104, and monitoring system 108 operatively coupled to the computer network 106. As depicted in FIG. 1, an administrative computer 110 is operatively coupled to the monitoring system 108, and a law enforcement computer 112 is operatively coupled to the monitoring system 108 through the computer network 106. As should be appreciated, the administrative computer 110 can be operatively coupled to the monitoring system 108 through the computer network 106, and the law enforcement computer 112 can be directly coupled to the monitoring system 108. In system 100, the tracking device 102 communicates with the monitoring system 108 and determines its location through wireless telephone antennas or cell phone towers 114, which are operatively coupled to the wireless provider system 104. As shown in FIG. 1, portable devices 116 communicate with the monitoring system 108 through the cell towers 114. The portable devices 116 can include, but are not limited to, both analog and digital cell phones, pagers, personal digital assistants (PDAs), a laptop computers and the like. In one embodiment, the portable devices 116 are cell phones. The portable devices 116 include a portable law enforcement device 118 that is used by monitoring system 108 to alert law enforcement officials of violations and a victim or at risk individual device 120 that is used alert at risk individuals, such as a person with a restraining order, that a monitored person is in close proximity. Moreover, as illustrated in FIG. 1, tracking device 102 incorporates portable device 116.

The monitoring system 108 is used to track the location of monitored individuals and report to the law enforcement officials and/or potential victims any parole and/or restraining order violations. The monitored individuals can include, but are not limited to, parolees, house arrest detainees, persons whom have a restraining order placed against them, and other persons to whom the criminal legal system wishes to track. For example, when a parolee violates the location restrictions of their parole, monitoring system 108 determines that a violation has occurred and alerts law enforcement officials of the violation through law enforcement computer 112 and/or portable law enforcement device 118. In another example, the monitoring system 108 can alert an at risk individual through at risk individual device 120 that a monitored person has violated their restraining order and can give the location of the monitored person so that the at risk individual can take preventative measures to avoid the monitored person. Administrative computer is used to administer the monitoring system 108 and generate reports. As depicted in FIG. 1, the monitoring system 108 includes a processor 122 and memory 124. The monitoring system 108 along with computers 110 and 112 can include personal computers, portable devices 116, computer terminals, PDAs, and/or other types of devices generally known to those skilled in the art. In one embodiment, the monitoring system 108 is a personal computer encoded with software that performs the monitoring techniques as described below.

The processor 122 is used to control the operation of the monitoring system 108. The processor 122 may be comprised of one or more components. For a multi-component form of processor 122, one or more components may be located remotely relative to the others, or configured as a single unit. Furthermore, processor 122 can be embodied in a form having more than one processing unit, such as a multi-processor configuration, and should be understood to collectively refer to such configurations as well as a single-processor-based arrangement. One or more components of the processor 122 may be of electronic variety defining digital circuitry, analog circuitry, or both. Processor 122 can be of a programmable variety responsive to software instructions, a hardwired state machine, or a combination of these. Among its many functions, the memory 124 in conjunction with the processor 122 is used to store and determine the location of monitored individuals. As shown, monitoring system 108 can include a clock 126 for timing and tracking events. It should be understood that clock 126 can be hardware based and/or software based.

Memory 124 can include one or more types of solid state memory, magnetic memory, or optical memory, just to name a few. By way of nonlimiting example, memory 124 can include solid state electronic random access memory (RAM), sequential access memory (SAM) (such as first-in, first-out (FIFO) variety or last-in, first-out (LIFO) variety), programmable read-only memory (PROM), electronically programmable read only memory (EPROM), or electronically erasable programmable read only memory (EEPROM); an optical disk memory (such as a DVD or CD-ROM); a magnetically encoded hard disk, floppy disk, tape, or cartridge medium; or a combination of these memory types. In addition, the memory 124 may be volatile, non-volatile, or a hybrid combination of volatile and non-volatile varieties, and memory 124 can be in the form of removable memory. As illustrated, memory 124 can include removable memory 128 that can be in the form of a non-volatile electronic memory unit, optical memory disk (such as a DVD or CD ROM); a magnetically encoded hard disk, floppy disk, tape, or cartridge medium; or a combination of these or other removable memory types. Network 106 can include the Internet, one or more other wide area networks (WAN), a local area network (LAN), a proprietary network such as provided by America Online, Inc., a combination of these, and/or other types of networks generally known to those skilled in the art. In one form of the present invention, the network 106 includes the Internet.

The wireless telephone provider system 104 includes both analog or digital cell phone systems, such as wireless telephone systems that use Code-Division Multiple Access (CDMA), Personal Communication Services (PCS) and other types of wireless telephone networks/services as generally know to those skilled in the art. The wireless system 104 is operable to locate the portable devices 116 and transmit the location to the portable devices 116. The location of portable devices 116 can be determined through angle of arrival to towers 114, time of arrival to towers 114, through assisted GPS via satellite 130, a combination of these, and in other manners as generally know to those skilled in the art. In one embodiment, the location of portable devices 116 are tracked by using a SNAPTRACK brand assisted-GPS system.

As illustrated in the FIG. 1, the tracking device 102 includes two components, a wearable transmitter or device 132 and monitored portable device 134 (116). The device 132 is wearable by the monitored person and periodically transmits a status signal to device 134. In one embodiment, device 132 is an ankle bracelet attached to the ankle of the monitored person and device 134 is a cellular telephone. As should be appreciated, device 132 and device 134 can be separate components or integrated into a single unit. In one form, device 132 and device 134 are operatively coupled to one another through a wireless connection. Wearable device 132 is operable to only transmit for a limited range. It should be appreciated that device 132 and device 134 can be operatively coupled to one another using a radio frequency transmission protocol, such as using Blue tooth technology or IEEE 802.11.

Figure 2:
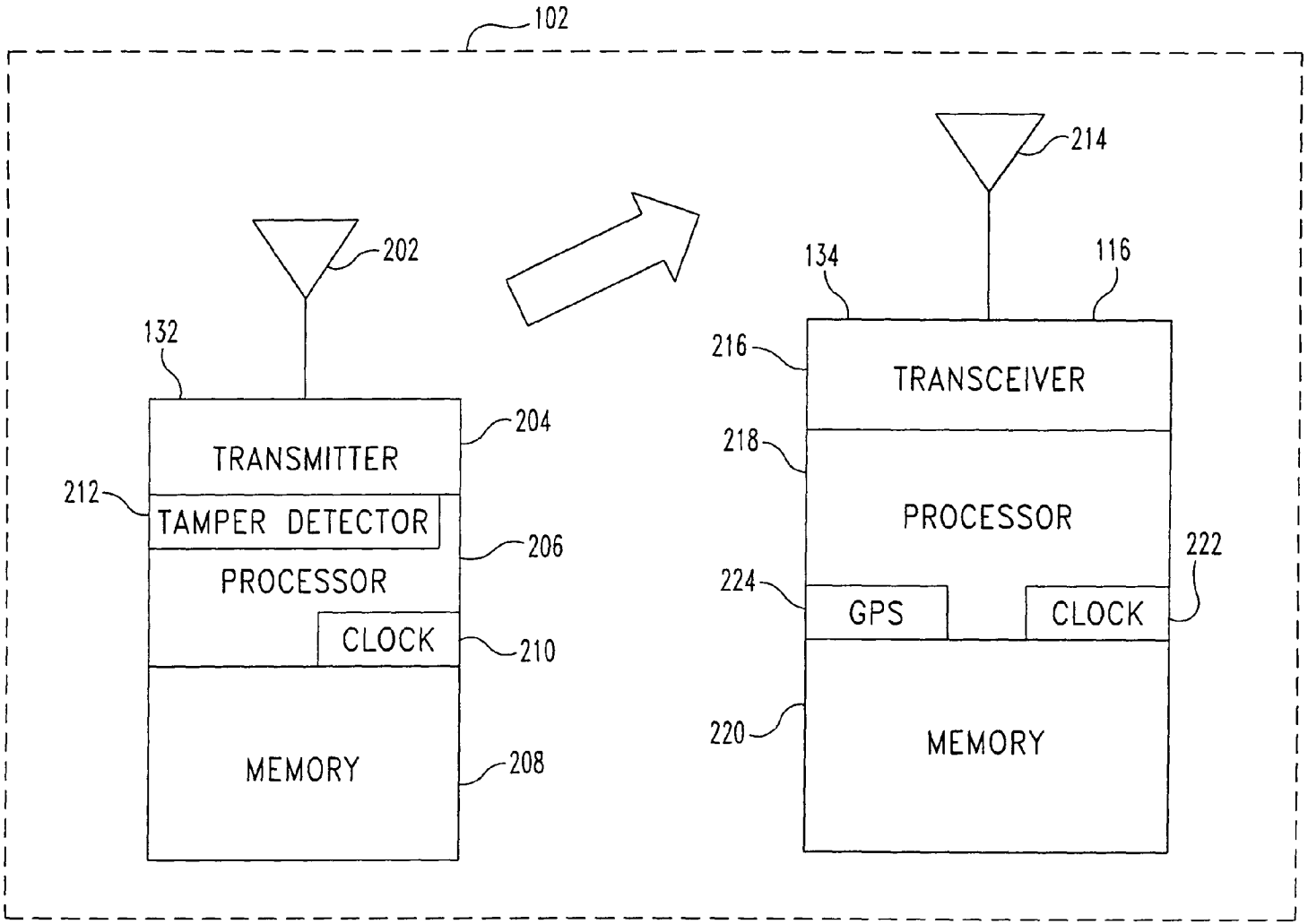
FIG. 2 is a diagrammatic view of a tracking device used in the FIG. 1 system.

As depicted in greater detail in FIG. 2, wearable device 132 includes an antenna 202, a transmitter (or transceiver) portion 204, a processor 206, memory 208 and a clock 210. The processor 206, memory 208 and clock 210 are similar to the ones described above. Transmitter portion 204 and antenna 202 are used to transmit the status signal to device 134. As should be appreciated, both device 132 and device 134 can be powered through a battery, fuel cell and/or in other generally known manners. As shown, device 132 includes a tamper evidence detector 212 for detecting the monitored person tampering with device 132 in an attempt to remove the wearable device 132. The tamper evidence detector 212 can include, but is not limited to, a thermal sensor for sensing body temperature and a wire though a strap that secures the wearable device 132 to the monitored person. Portable device 134 includes an antenna 214, a transceiver 216, a processor 218, memory 220 and a clock 222. Antenna 214 and transceiver 216 are used for communicating with the wearable device 132 and the cell towers 114. Processor 218, memory 220 and clock 222 are similar to the ones described above. As an optional feature, when assisted GPS is used, monitored portable device 134 can include a GPS receiver 224.

Figure 3:
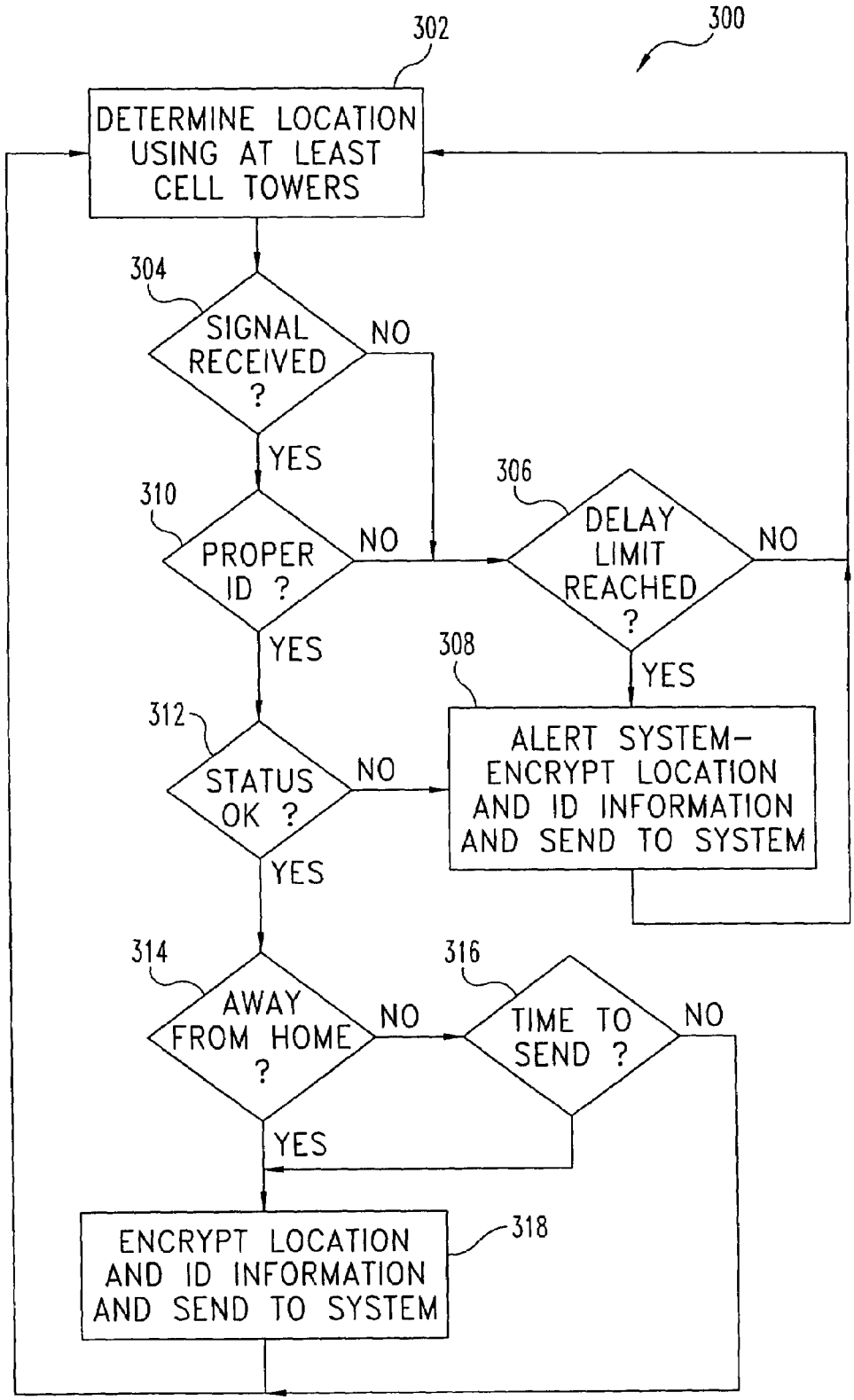
FIG. 3 is a flow diagram illustrating a technique for location tracking of monitored individuals according to one embodiment of the present invention.

A technique according to one embodiment for transmitting the status of the monitored device 102 is illustrated with flow diagram 300 in FIG. 3. In stage 302, portable device 134 determines its location through cell towers 114 and the wireless provider system 104 (i.e., enhanced 911 service). By using cell towers 114 to locate as to solely locating using other types of systems, such as GPS, the monitored device 102 is able to be tracked even when indoors. This improves the overall location determination efficiency. Processor 218 of device 134 stores its location in memory 220. The wearable device 132 periodically transmits status information to device 134. In one embodiment, the wearable transmitter transits identification and status information to portable device 134 every five (5) seconds. In stage 304, device 134 determines whether a signal has been received from device 132. If the status signal has not been received, the processor 218 determines whether a delay limit between signals has been reached. The wearable device 132 is given a specified period of time to communicate with the portable device 134. This delay limit reduces the number of false alarms caused by conditions, such as radio interference or the monitored person being temporarily away from the portable device 134. In one embodiment, the delay time limit is fifteen (15) seconds. As should be appreciated, other time limits can be used, depending on operational conditions. If in stage 306 the delay time limit has yet been reached, the processor 218 in the portable device 134 continues to determine its current location in stage 302. Otherwise, when the delay time limit has been reached in stage 306, processor 218 transmits an encrypted alert message to monitoring system 108 in stage 308. The alert message is sent via the cell towers 114 of the wireless telephone network 104 and network 106 to the monitoring system 108. In stage 308, the portable device 134 encrypts the location data from stage 302 along with a portable device/monitored person identifier. By encrypting this information, the privacy of the persons tracked by system 108 is preserved even when transmitted across a publicly accessible networks 104 and 106. Privacy is especially important for a person with a restraining order. By encrypting communications, the restrained monitored person is unable to locate easily the person with a restraining order. The portable device identifier is used to identify the monitored person. In one form, this identifier is a unique serial number. It should be understood that other types of identifiers can be used to identify the monitored system. In one embodiment, processor 218 encrypts the location and identifier information using a two key or asymmetric encryption algorithm. Following stage 308, the processor 218 of the portable device 116 continues to monitor its location in stage 302 and for a signal in stage 304.

As mentioned above, the wearable device 132 periodically transmits a signal containing status information along with an identifier that identifies the wearable transmitter 134. The unique identifier can be a serial number or some other type of identifier as known by those skilled in the art. In one form, the identifier transmitted by the wearable device 132 is the same as the portable device identifier. In another form, the wearable transmitter pseudo-randomly changes the identifier at specified timer intervals in order to prevent tampering. In one embodiment, the status and identifier information is encrypted using an asymmetric encryption algorithm. It should be appreciated that other types of encryption algorithms can also be used. When the portable device 134 receives a signal in stage 304, processor 218 determines whether the signal contained the proper identifier. If not, processor 218 determines whether the delay time limit was reached in stage 306, and when required, alerts the monitoring system 108 in stage 308. If the portable device 134 determines that the proper identifier was received in stage 310, processor 218 determines in stage 312 whether the status portion of the received signal indicates that the status of the wearable device 132 is normal. The status signal from wearable device 132 will not be normal or "OK" when the wearable device 132 is not operating properly. For example, if the tamper evidence device 212 detects tampering with the wearable device 132, the wearable device 132 sends a "tamper" status signal to the portable device 134. In another example, the wearable device 132 sends a "low battery" signal when the charge of batteries in the wearable device 134 are low. When the status of the wearable device 132 is not normal in stage 312, the portable device 134 sends an alert to the monitoring system 108 in stage 308. As should be understood, the portable device 134 can further send the status information from the wearable device 132 to the monitoring system 108 in stage 308.

In stage 312, when the status of the wearable device 132 is normal, the portable device 132 in stage 314 determines whether the monitored person is away from a designated "home" location or zone. To reduce traffic on system 100, the portable device 132 and monitoring system 108 incorporates a variable transmission rate feature according to the present invention. Not only does this feature reduce communication traffic, this feature also reduces resource demands on the monitoring system 108 so that a larger number of persons can be monitored at the same time. With this feature, the portable device 134 reduces the number of location/status transmissions to the monitoring system 108 when the monitored person is at a "home" location, such as their home or place of work. This reduces the amount of redundant location information received and processed by the monitoring system 108. When a monitored person is on the move, such as travelling away from their home, location information is sent to the monitoring system 108 at a higher rate.

With this technique, both portable device 134 and system 108 are aware of when the transmission rate of location information is adjusted. This makes it more difficult for a monitored person to circumvent safety protocols in system 108. In one embodiment, one or more "home" locations are preprogrammed in the portable device 134 and stored in memory 124 of the monitoring system 108 when the monitored person is initially registered with the system 108. In another embodiment, the portable device 134 downloads one or more "home" locations periodically (such as every night) from the monitoring system 108. In still yet another embodiment, the portable device 134 dynamically creates a "home" location. When a person has not moved from a location for a specified period of time, the portable device sends a "home" location signal to the monitoring system 108 to alert the monitoring system 108 that the portable device 134 is going to increase the period between transmissions. In one form, when the location determined in stage 302 has not changed for ten minutes, the portable device 134 sends a signal to the monitoring system 108 designating the current location as a "home" location and changes to a "home" location transmission mode.

When in stage 314 the processor 218 of the portable device 134 determines that the monitored person is at a "home" location, processor 218 in stage 318 determines whether it is time to send the location information under "home" transmission mode. In one embodiment, the portable device 132 sends its location every five minutes in the "home" transmission mode and every thirty seconds when not in the "home" transmission mode. It should be appreciated that other time intervals can be used. When the time has elapsed in stage 316 or the monitored person is away from a "home" location in stage 314, the portable device 134 encrypts and sends to the monitoring system the portable device identifier along with the location information. In stage 316, if the time interval between transmissions in the "home" transmission mode has not elapsed, the portable device 134 does not send location information to the monitoring system 108 and determines its current location in stage 302.

Figure 4:
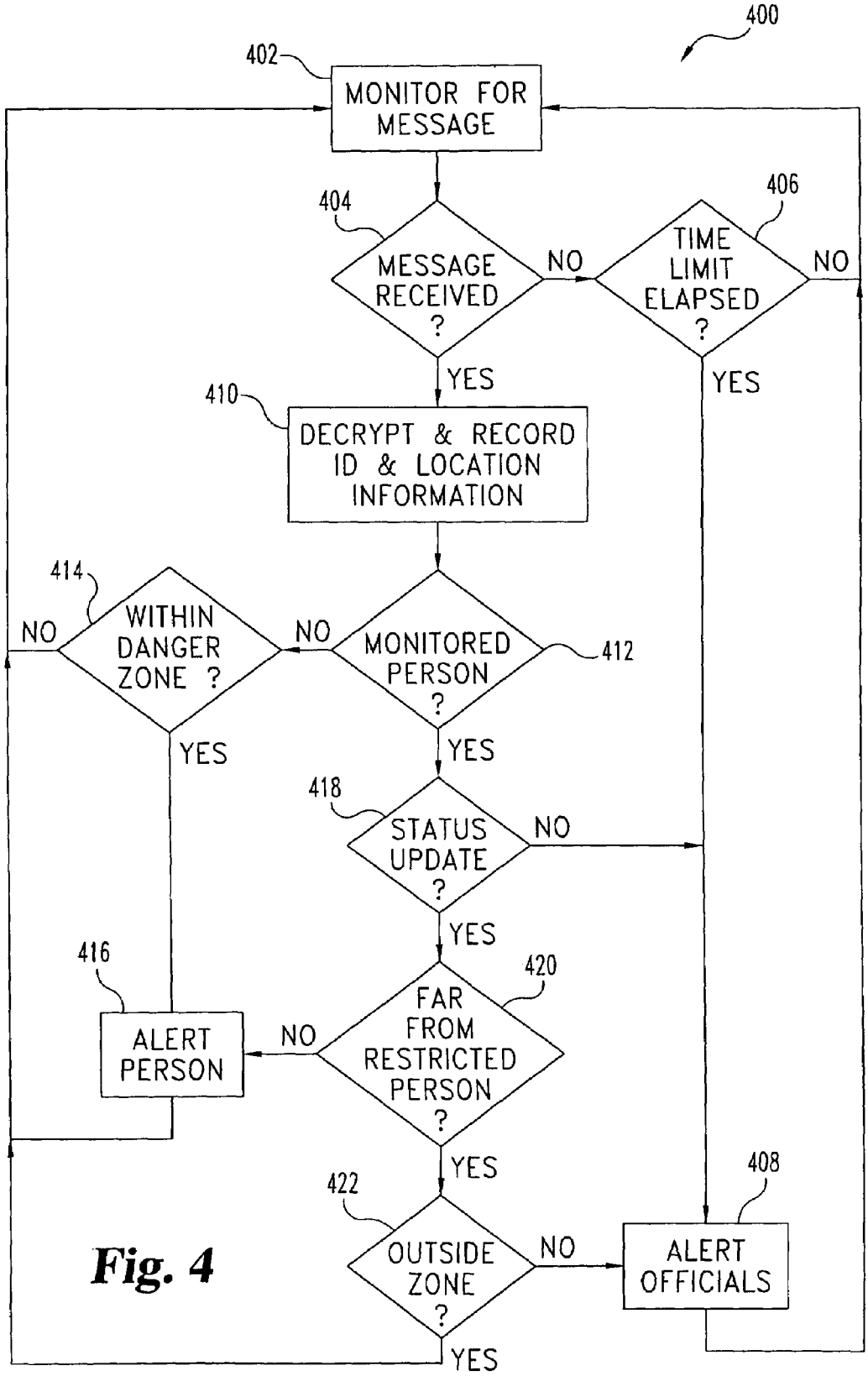
FIG. 4 is a flow diagram illustrating a technique for processing violations by the monitored individuals with the FIG. 1 system.

A technique for processing messages from monitored persons is illustrated with flow diagram 400 in FIG. 4. In stage 400, the monitoring system 108 monitors for messages from the network 106, and the processor 122 of the monitoring system 108 determines in stage 404 whether a message has been received in stage 404. If a message has not been received, processor 122 determines whether an allowable time between messages limit has been reached for any of the monitored persons. As discussed above, the time limit between message can be variable, depending on whether the monitored person is at a "home" location or not. The monitoring system 108 maintains time limit and other information about the monitored persons in memory 124. By way of nonlimiting example, the information stored in memory 124 can include the name of the monitored person, description, criminal record, home address, telephone number, place of work, work schedule, permitted locations of travel, restraining order information, time limits between messages information, last known location, identifier for the portable device 134, historical travel information and the like. In one embodiment, the information stored in memory 124 is stored in a database. As should be appreciated, other types of data structures can be used to store information in memory 124. In stage 406, if the time limit between messages has not elapsed for a monitored, processor 122 of the monitoring system 108 continues to monitor for messages in stage 402.

When the time limit for a particular monitored person has elapsed in stage 406, the monitoring system 108 alerts officials of the violation. The alert can contain the name of the monitored person, description and their last known location. It should be appreciated that the alert can contain additional information. In one embodiment, the monitoring system 108 sends the alert across the network 106 to the law enforcement computer 112, and in one form, the monitoring system 108 sends an email containing the alert to the law enforcement computer 112. In another form, an alert web page is displayed on the law enforcement computer 112. Once the alert is received, law enforcement officials can be dispatched in order to find the monitored person. Alternatively or additionally, the monitoring system 108 can contact the closets available law enforcement official through portable law enforcement device 118. The location of the law enforcement portable device 118 is monitored in the same fashion as described above for the monitored person. Device 118 periodically sends location and identification information to the monitoring system 108 via towers 114. Processor 122 stores in memory 124 the location of various law enforcement officers, and based on their location, monitoring system 108 contacts the closets law enforcement official via portable device 118. For example, the monitoring system 108 can send to device 118 a voice message and/or text message (page) alerting the officer that a particular monitored person needs to be contacted or apprehended. Once alerted, law enforcement official can take appropriate action. In the embodiment illustrated in FIG. 1, both the law enforcement portable device 118 and portable device 134 are operable to communicate directly with one another without the use of towers 114. In one form, devices 118 and 134 use NEXTEL brand's "direct connect" feature to communicate with one another. This allows the law enforcement official to quickly contact the monitored person and quickly remedy any problems. For instance, the official can directly contact the monitored person in order to provide them instructions on how to handle any equipment problems.

After the alert is sent in stage 408, processor 122 of the monitoring system 108 continues to monitor for messages in stage 402. Once a message is received in stage 404, the monitoring system 108 decrypts the message and records in memory 124 the identifier and location information contained in the message in stage 410. As discussed above, not only does system 108 track the location of monitored individuals, such as parolees, system 108 further tracks the location of law officials via device 118 and at risk individuals, such as persons with restraining orders, via device 120. Further, in stage 410, monitoring system 108 can update any changes to the designated "home" location and/or allowed time limits between messages. Based on the identifier in the message, processor 122 determines in stage 412 whether the message was from a monitored person. If not, processor 122 assumes that the message is from either a law enforcement official or an at risk person. At risk individuals, such as persons with retraining orders or domestic abuse safe houses, can register with the monitoring system 108 in order to prevent specific monitored persons from coming within a specified distance of the at risk individuals. For instance, a person with a restraining can register with system 108 to prevent a stalker from coming within 500 meters of them.

In stage 414, the monitoring system 108 determines if the monitored person is too close to the at risk person or within a "danger zone" with respect to the at risk person. If the at risk individual is not close to a specified or targeted monitored person, system 108 continues to monitored for messages in stage 402. Otherwise, the monitoring system 108 in stage 416 alerts the at risk individual that the monitored person is close via device 120. The monitoring system 108 can send a text, voice and/or other type of message, which provides the name of the monitored individual, their location and direction of travel. As should be understood, the monitoring system 108 can supply other information. By alerting the at risk person of the close proximity of the monitored person, the at risk person can take appropriate actions to avoid the monitored individual. To further improve the location accuracy of the monitored individual, the monitoring system in stage 416 sends a command over provider network 104 to the monitored portable device 134 of the targeted monitored individual so as to remove the "home" operational mode and/or increase the message update rate from device 134. This improves location determination accuracy when the need for accurate location information is the most critical. In addition, the monitoring system 108 in stage 416 can alert officials in a manner similar to the one described above for stage 408. After stage 416, the monitoring system 108 continues to monitor for messages in stage 402.

In stage 412, when processor 122 determines the received message was from a monitored person, processor 122 in stage 418 determines whether the message contained a normal status update. As discussed above, device 134 sends an alert status message when for example the wearable device 132 has been tampered with or portable device 134 did not receive a transmission from the wearable device 132 within a specified period of time. If the message does not contain a normal status update in stage 418, the monitoring system 108 alerts the law enforcement officials in stage 408. The alert can contain a message on the particular problem experienced with the portable device 134. When system 102 is operating normally, the monitoring system 108 receives a normal status message, and in stage 420, processor 122 determines whether the monitored person is far enough away from the at risk or restricted person. When the monitored person is too close to a particular at risk person, the monitoring system 108 alerts the at risk person in stage 416. As mentioned above, the monitoring system 108 in stage 416 can further alert officials of the violation. As should be appreciated, not all monitored persons may be prohibited from coming into close proximity of an at risk persons. For instance, a home detainee may not have a restraining order against them.

The monitoring system 108 stores in memory 124 the locations or zone in which the monitored person is allowed to travel. When in stage 420 the monitored person is not restricted from particular at risk individuals or is far from any restricted individuals, the monitoring system 108 determines in stage 422 whether the monitored person is outside the zone in which they are allowed to travel. If the monitored person is outside the zone, the monitoring system 108 alerts the appropriate officials in stage 408. Otherwise, the monitoring system 108 continues to monitor for messages in stage 402.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method, comprising:

receiving status signals with a portable device from a wearable device worn by a person, wherein the status signals indicate operational status of the wearable device, wherein the operational status includes an indication of whether the person has tampered with the wearable device;

determining location of the portable device;

transmitting messages from the portable device to a monitoring system via a wireless telephone network, wherein the messages include the location of the portable device and the operational status of the wearable device; and adjusting transmission rate of the messages from the portable device to the monitoring system by reducing the transmission rate when the portable device is within a specified region and increasing the transmission rate when the portable device is outside the specified region.

2. The method of claim 1, further comprising:

determining the portable device has remained in the specified region for a specified period of time before said adjusting; and sending a signal to the monitoring system designating the specified region as permitting as a reduction in the transmission rate.

3. The method of claim 1, further comprising receiving a signal from the monitoring system designating the specified region before said adjusting.

4. The method of claim 1, wherein said determining the location of the portable device includes triangulating position of the portable device in relation to the wireless telephone network.

5. The method of claim 4, said determining the location of the portable device includes determining the position based on signals received from a global positioning system.

6. The method of claim 1, further comprising alerting the monitoring system when the status signals are not received from the portable device.

7. A method, comprising:

storing a specified region in a monitoring system and a portable device possessed by a monitored person;

receiving messages at a monitoring system from the portable device via a wireless telephone network, wherein the messages include location of the portable device;

adjusting allowable time between the messages from the portable device by increasing the allowable time between the messages when the portable device is within the specified region and decreasing the allowable time between the messages when the portable device is outside the specified region; and alerting a law enforcement official of a violation, wherein the violation includes when the allowable time between the messages is exceeded.

8. The method of claim 7, further comprising:

determining the location of the portable device is in a restricted zone; and alerting the law enforcement official in response to said determining.

9. The method of claim 7, further comprising:

determining the location of the portable device is violation of a restraining order for an individual; and alerting the individual of the violation of the restraining order and the location of the portable device.

10. The method of claim 7, wherein said alerting includes sending an alert message via the wireless network to a law enforcement portable device that is possessed by the law enforcement official.

11. The method of claim 10, wherein:

the law enforcement portable device includes a cellular telephone operable to communicate directly with the portable device of the monitored person; and communicating directly between the law enforcement portable device and the portable device of the monitored person.

12. A system, comprising:

a processor operable to receive messages containing location of a portable device in possession of a monitored person via a wireless telephone network;

memory operatively coupled to said processor, said memory being operable to store rules pertaining to said monitored person, wherein the rules include an allowable time between the messages and a designated area in which the allowable time between the messages is increased;

wherein said processor is operable to increase the allowable time between the messages when the portable device is located in the designated area; and wherein said processor is operable to alert an individual when the portable device violates at least one of the rules in said memory.

13. The system of claim 12, wherein:

said memory is operable store a restricted area for the monitored person, wherein the rules include the restricted area; and said processor is operable to alert the individual when the portable device is located inside the restricted area.

14. The system of claim 13, wherein the individual includes a law enforcement officer, the monitored person includes a parolee and the restricted area is based on parole requirement of the parolee.

15. The system of claim 13, further comprising:

the wireless telephone network operatively coupled to the processor;

the portable device operatively coupled to the wireless telephone network;

a device possessed by the individual and operatively coupled to the wireless telephone network; and wherein said processor is operable to determine location of the individual based on messages received from said device possessed by the individual.

16. The system of claim 15, wherein the individual includes a person having a restraining order against the monitored person and the restricted area is based on the restraining order.

17. The system of claim 15, further comprising a publicly accessible computer network operatively coupled between the wireless telephone network and said processor, said computer network being operable to convey the encrypted messages.

* * * * *